US006781501B2

(12) United States Patent
Layton

(10) Patent No.: US 6,781,501 B2
(45) Date of Patent: Aug. 24, 2004

(54) LOW EXTERNAL FIELD INDUCTOR

(75) Inventor: James Edward Layton, Chelsea, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/999,346

(22) Filed: Nov. 15, 2001

(65) Prior Publication Data

US 2003/0090357 A1 May 15, 2003

(51) Int. Cl.[7] ..... H01F 27/28
(52) U.S. Cl. ..... 336/229; 336/84 R; 29/605
(58) Field of Search ..... 336/229, 84 R, 336/189, 190, 191, 225; 29/605, 602.1, 606

(56) References Cited

U.S. PATENT DOCUMENTS

| | | | | |
|---|---|---|---|---|
| 1,691,699 A | | 11/1928 | Cardwell | |
| 2,306,693 A | | 12/1942 | Gloss | 250/33 |
| 3,726,004 A | * | 4/1973 | Holland et al. | 29/602.1 |
| 4,712,068 A | * | 12/1987 | Savelainen | 324/318 |
| 5,319,343 A | | 6/1994 | Jeffries | 336/181 |
| 5,565,835 A | | 10/1996 | Groehl | 336/181 |
| 5,565,836 A | | 10/1996 | Groehl et al. | 336/225 |

* cited by examiner

*Primary Examiner*—Anh T. Mai

(57) ABSTRACT

An inductor is wound axially around a cylindrical center structure, such as a core or form, so that each turn includes portions extending axially along a circumferential outer surface of the center structure and portions extending across the end surfaces of the center structure. Adjacent axial portions, which are preferably but not necessarily consecutive turns, carry current in the same direction to the extent possible. External magnetic fields therefore fall off rapidly and at least partially offset so that the inductor can handle high currents such as those relating to filtered electric power transmitted into a borehole for powering artificial lift equipment.

18 Claims, 6 Drawing Sheets

LOW EXTERNAL FIELD INDUCTOR

TECHNICAL FIELD OF THE INVENTION

The present invention is directed, in general, to winding configurations for inductive devices and, more specifically, to a winding configuration for an inductor reducing or minimizing external magnetic fields.

BACKGROUND OF THE INVENTION

Many configurations for the windings of an inductor around a core or form have been proposed or employed. The simplest and most common configuration involves progressive windings around the radial circumference of a cylindrical core or form. Alternative configurations, usually designed to maximize magnetic flux and/or inductance, increase sensitivity to electromagnetic waves, or reduce Lorentz forces, include toroidal windings (progressive windings around a doughnut-shaped core or form) and similar variations.

In borehole production, inductors are employed for filtering electric (normally three phase) power to be transmitted into the borehole. Surface voltage magnitudes of the electric power may equal or exceed 10 kilovolts (kV), with associated, proportionally high currents. For inductors having conventional configurations, such high currents through the windings can produce intense magnetic fields external to the inductor. The external magnetic fields, in turn, induce eddy currents within surrounding metals and conductors and, because of resistance, generate undesirable heat. As a result, cabinets for enclosing surface power equipment for borehole production systems must be made larger to provide extra distance so that the intense magnetic fields produced by the inductor do not produce significant eddy currents within the cabinet walls.

There is, therefore, a need in the art for a low external field inductor for use with borehole production electric power systems.

SUMMARY OF THE INVENTION

To address the above-discussed deficiencies of the prior art, it is a primary object of the present invention to provide, for use in borehole production system, an inductor which is wound axially around a cylindrical center structure, such as a core or form, so that each turn includes portions extending axially along a circumferential outer surface of the center structure and portions extending across the end surfaces of the center structure. Adjacent axial portions, which are preferably but not necessarily consecutive turns, carry current in the same direction to the extent possible. External magnetic fields therefore fall off rapidly and at least partially offset so that the inductor can handle high currents such as those relating to filtered electric power transmitted into a borehole for powering artificial lift equipment.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the DETAILED DESCRIPTION OF THE INVENTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

FIGS. 1 through 8, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged device.

Figure 1:
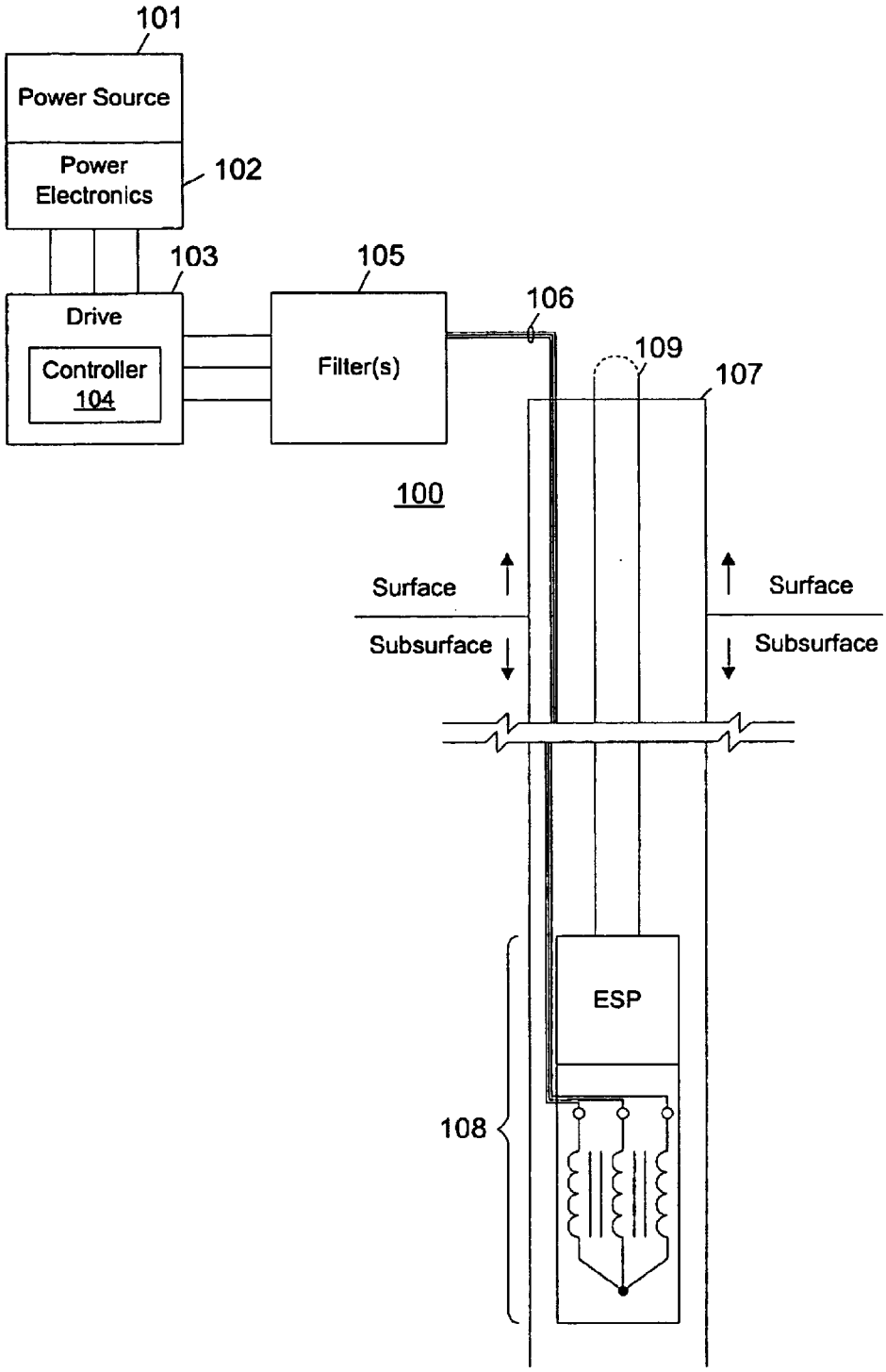
FIG. 1 depicts a borehole production system employing a low external field inductor for filtering a drive transmitting power into the borehole according to one embodiment of the present invention.

FIG. 1 depicts a borehole production system employing a low external field inductor for filtering a drive transmitting power into the borehole according to one embodiment of the present invention. Production system 100 includes a power source 101, such as a generator or a connection to the local alternating current (A/C) power grid, coupled by power electronics 102 to an electrical drive 103, which in the exemplary embodiment is preferably a variable frequency drive (VFD) capable of operating in one or more of an n-step variable voltage inverter (VVI) mode and a pulse width modulation (PWM) mode.

Drive 103, under operational control of an associated controller 104, generates electrical power (typically three phase power) which is passed through resistive-capacitive (RC) filter(s) 105, which typically include series-, Y-, or delta-connected capacitor(s) and inductor(s), then transmitted over power cable(s) 106 into a borehole 107. The transmitted power is received within the borehole 107 by artificial lift equipment 108 coupled to production tubing 109 and lowered within the borehole 107 in accordance with the known art. Those skilled in the art will recognize that artificial lift equipment 108, which in the exemplary embodiment preferably comprises an induction motor and a submersible centrifugal pump forming an electrical submersible pump (ESP) system, operates in response to the received power to assist in production of oil, gas, and other hydrocarbon fluids from the borehole 107. A detailed description of the construction and operation of a suitable electrical submersible pump system is contained in U.S. Pat. No. 6,167,965, issued to the assignee of the present invention.

Those skilled in the art will recognize that the complete construction and operation of a borehole production system is not depicted or described herein. Instead, only so much of the borehole production system as is unique to the present invention or necessary for an understanding of the present invention is shown and described. However, borehole production system 100 includes, embodied chiefly within filter(s) 105, one or more low external field inductors according to the present invention as described in greater detail below.

Figure 2A:
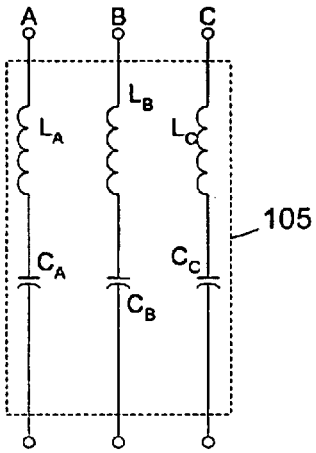
FIGS. 2A through 2C are circuit diagrams for suitable filter configurations including low external field inductors for use in the electric power structure of a borehole production system according to various embodiments of the present invention.
Figure 2B:
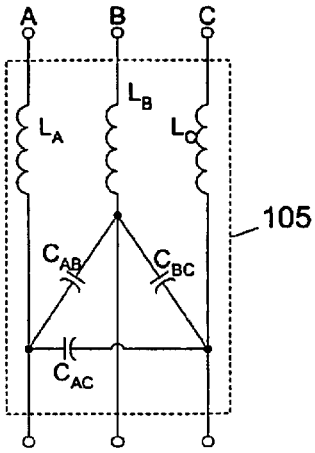
Figure 2C:
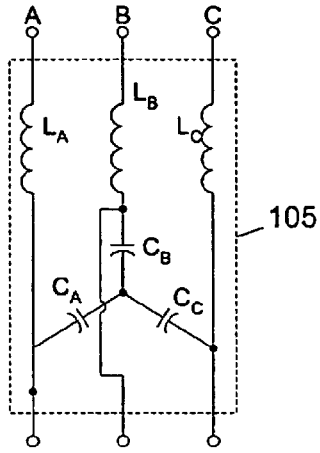

FIGS. 2A through 2C are circuit diagrams for suitable filter configurations including low external field inductors for use in the electric power structure of a borehole production system according to various embodiments of the present invention. Series-, Y-, and delta-connected filters are respectively depicted. In the present invention, each of the inductors $L_A$, $L_B$ and $L_C$ are preferably low external field inductors as described below. Moreover, those skilled in the art will recognize that such low external field inductors may be employed at other locations within the electric power structure of a borehole production system, such as in filters for taps to the power cable conductors within the borehole.

Figure 3A:
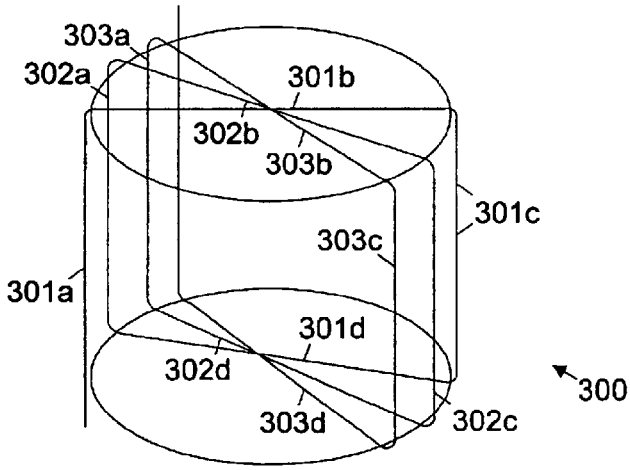
FIGS. 3A through 3C are various views of the windings of a low external field inductor according to one embodiment of the present invention.
Figure 3B:
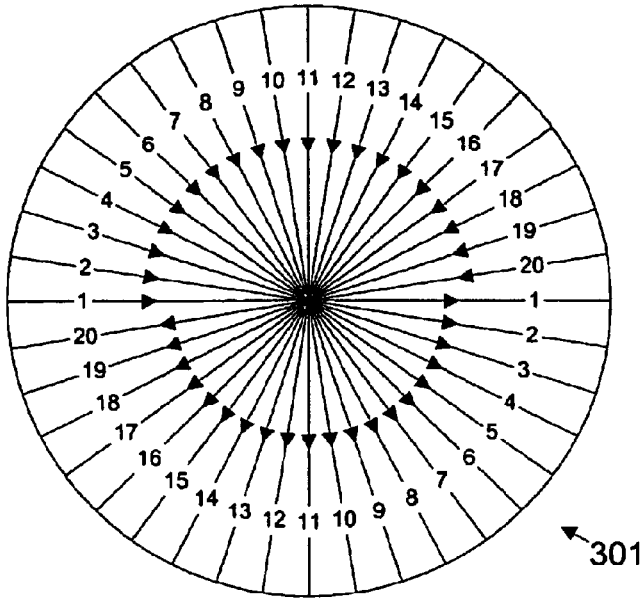
Figure 3C:
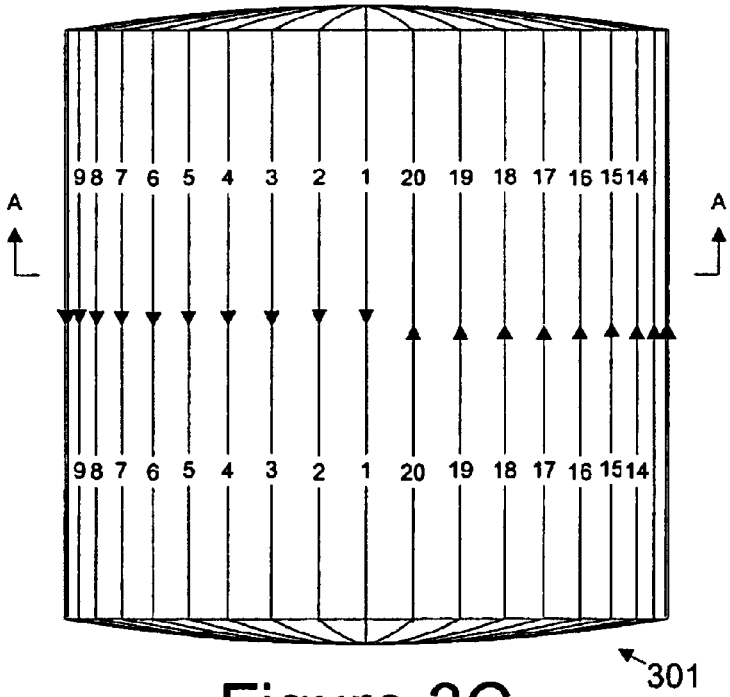

FIGS. 3A through 3C are various views of the windings of a low external field inductor according to one embodiment of the present invention. FIG. 3A is a perspective view of a partially wound inductor 300. As with conventional inductors, a cylindrical or drum-shaped core or form is employed for low external field inductor 300. However, windings on a conventional inductor are around a radial circumference of the core or form and progress axially, forming a helix. Windings on low external field inductor 300, however, are directed axially and progress radially (on both sides) around the circumferential outer surface of the core or form. On inductor 300, a first winding or turn includes: a portion 301*a* extending axially along the circumferential outer surface of the core or form; a second portion 301*b* extending diagonally across one end surface of the cylindrical core or form; a third portion 301*c* also extending axially along the circumferential outer surface of the core or form, but on the side opposite portion 301*a*; and a fourth portion 301*d* extending diagonally across a second end surface of the cylindrical core or form. The second and third turns similarly include portions 302*a*–203*d* and 303*a*–303*d*, respectively, with axial portions 302*a* and 302*c* of the second turn each advanced in a clockwise direction (viewed from the top end) around the circumferential outer surface from corresponding axial portions 301*a* and 301*c* of the first turn, and axial portions 303*a* and 303*c* of the third turn each advanced in a clockwise direction around the circumferential outer surface from corresponding axial portions 302*a* and 302*c* of the second turn.

Each diagonal end portion of a turn crosses over the corresponding diagonal end portions of all previous turns, with end portions 302*b* and 302*d* crossing over end portions 301*b* and 301*d*, respectively, end portion 303*b* crossing over both end portions 301*b* and 302*b*, and end portion 303*d* crossing over both end portions 301*d* and 302*d*. In this manner, axial portions of a turn advance from the previous turn in the same direction around the circumferential outer surface of the core or form on both sides. While the axial portions of the turns progress clockwise (viewed from the top end) in the example shown, counterclockwise progress is equally suitable.

The windings are continued around the core or form in the manner shown until the desired number of windings for inductor 300 are complete. The axial portions of successive turns may be directly adjacent and touching on each side, or may be (preferably uniformly) spaced apart around the circumferential outer surface of the core or form.

FIGS. 3B and 3C are an end view and a side elevation view, respectively, of a completely wound low external field inductor 301 according to one embodiment of the present invention. Inductor 301 has twenty uniformly spaced turns, identified numerically, with arrowheads indicating the direction of current flow within the respective turn. As can be seen from FIG. 3C, current flows in same direction within adjacent axial portions of the winding pairs (with the exception of the winding pair containing the first and last turn). For those adjacent winding pairs for which current flows in the same direction, the resulting external magnetic fields will fall off rapidly with distance from a given axial turn portion and will also at least partially offset. Internal magnetic fields also partially offset, but will accumulate somewhat and therefore remain sufficiently strong to produce an inductance due to the concentration over a smaller area.

Inductor 301 can handle high currents without creating an intense external magnetic field, and does not appreciably affect, nor is appreciably affected by, ferromagnetic material in close proximity. Useful for power systems, one application of inductor 301 is air core inductors for pulse width modulated (PWM) output filters on power system inverters. Another suitable use is high quality (Q) inductors for radio frequency (RF) signals, providing an inductor minimally affected by surrounding as well as minimizing radiation. While an air core is suggested for the exemplary embodiment, a high permeability core may be employed to produce higher inductance per unit volume.

Figure 4:
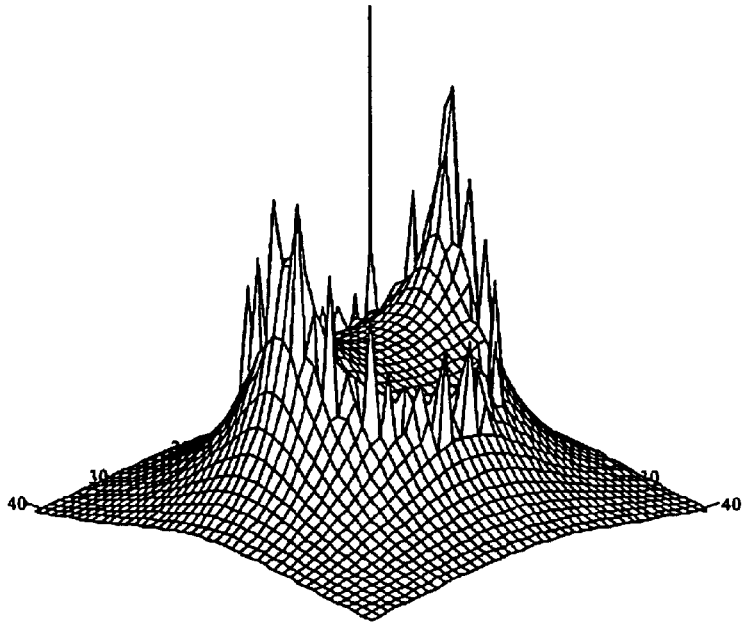
FIGS. 4 through 6 are various plots of the magnetic field produced by a low external field inductor according to one embodiment of the present invention.
Figure 5:
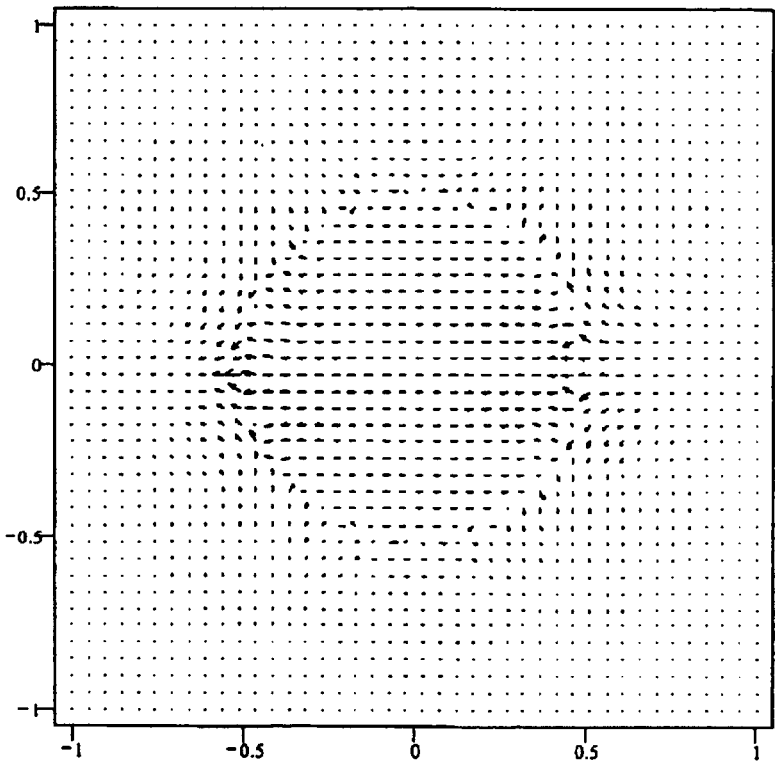
Figure 6:
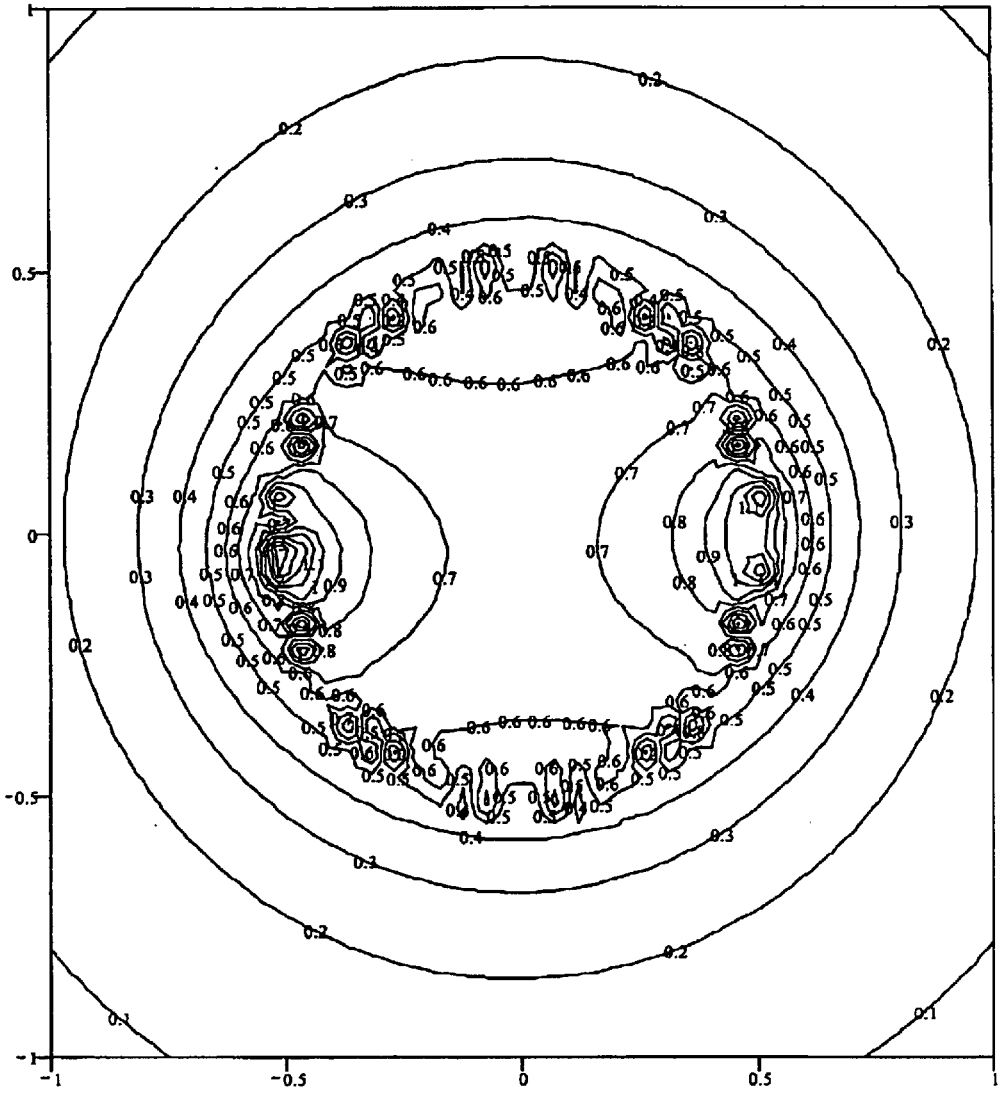

FIGS. 4 through 6 are various plots of the magnetic field produced by a low external field inductor according to one embodiment of the present invention. The diagrams relate to the magnetic field of inductor 301 depicted in FIGS. 3B and 3C, taken at a section A—A at an arbitrary position along the axial length of inductor 301. FIG. 4 is a three dimension plot of magnetic field intensity as a function of distance from the axis of inductor 301, while FIG. 5 is a vector view of the magnetic field and FIG. 6 is a contour map of magnetic field intensity.

Referring back to FIGS. 3B and 3C, inductance for inductor 301 may be calculated from:

$$L = \frac{\mu_0}{\pi}\left[nd_c\left[1 + 2\sum_{k=1}^{\frac{n}{4}}\cos\left(\frac{2\pi}{n}k\right)\right]\right]\ln\left(\frac{h}{2\cdot d_w}\right) + \frac{\mu_0}{\pi}\left[nh\left[1 + 2\sum_{k=1}^{\frac{n}{4}}\cos\left(\frac{2\pi}{n}k\right)\right]\right]\ln\left(\frac{d_c}{2\cdot d_w}\right)$$

where L is the inductance, $$\mu_0 = 4\pi\times 10^{-7}\ \frac{\text{volt}\cdot\text{sec}}{\text{amp}\cdot\text{m}},$$

n is the number of complete turns or loops, $d_c$ is the cylinder diameter, h is the cylinder height, and d, is the wire diameter. For a cylinder having equal diameter and height of 1.13 inches and wound 68 complete turns in the manner of inductors 300 and 301 with wire having a diameter of 0.027 inches, the inductance will be approximately 103.19 micro-Henrys ($\mu$H).

Those skilled in the art will recognize that, for use in filter(s) 105, the desired inductance of inductor 301 will vary inversely with the magnitude of electric power being transmitted into the borehole. For example, for 1,000 kilo-volt-amps (kVA), a 40 mH inductor might be required; for 500 kVA, an 80 mH inductor; and for 250 mH, a 160 mH inductor. Specific values will depend on other system particulars.

Figure 7:
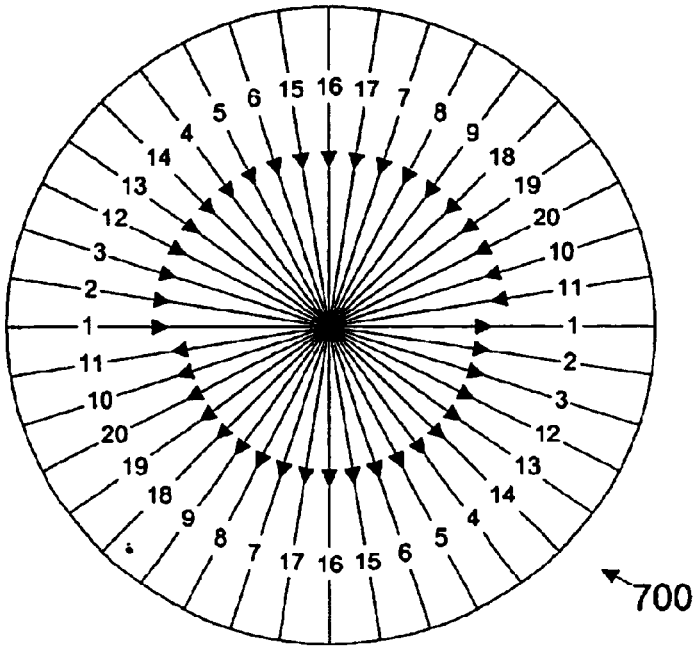
FIGS. 7 and 8 are end views of alternative winding configurations for a low external field inductor according to one embodiment of the present invention.
Figure 8:
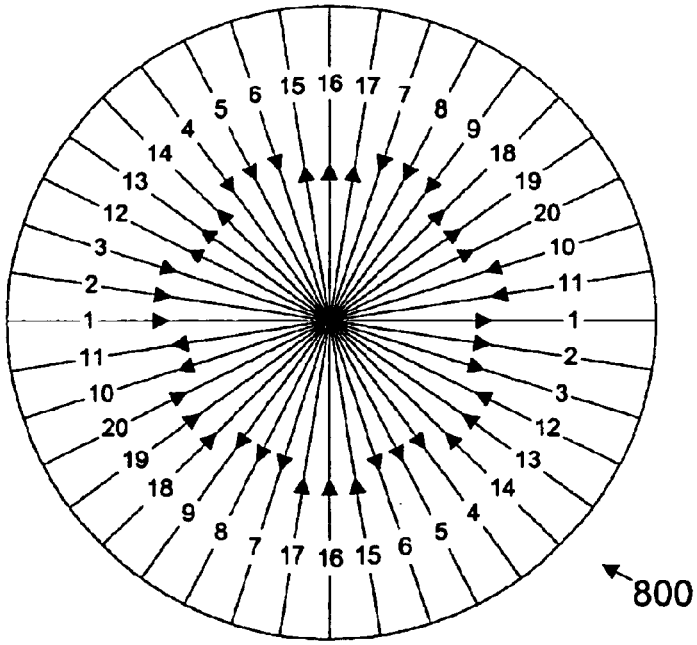

FIGS. 7 and 8 are end views of alternative winding configurations for a low external field inductor according to one embodiment of the present invention. As with FIG. 3B, the twenty turns are numerically identified and arrowheads indicate the direction of current flow.

Variations in the winding configuration illustrated by inductor 301 may be desirable or necessary for physical reasons or for ease in manufacture. FIG. 7 illustrates that adjacent turns (along the axial length) need not necessarily be consecutive turns. One or more consecutive turns may be wound adjacent to each other, then a space skipped before another set of adjacent, consecutive turns, with the intervening gap filled by later turns. However, the winding is again configured so that current in adjacent axial portions of the turns is in the same direction to the extent possible. Inductor 700 illustrates groups of three turns, although the same technique may be employed with single turns or groups of any number of turns.

FIG. 8 illustrates that the inductor need not necessarily be wound so that axial portions of turns carrying current in the same direction are all adjacent, to the extent possible, as with inductors 301 and 700. Inductor 800 illustrates two spaced groups of three turns having axial portions carrying current in the same direction, separated by a group of three turns having axial portions carrying current in the opposite direction. The number and spacing of turns having adjacent axial portions carrying current in the same direction may be varied, as long as at least two adjacent axial portions carry current in the same direction to reduce external magnetic fields.

It should be noted that the core or form need not be perfectly cylindrical, but may instead have, for example, an octagonal cross-section. End portions of the core or form may be rounded, or may include guides for the winding portions across the ends.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention in its broadest form.

What is claimed is:

1. An inductor, comprising:

a center structure; and axial windings around the center structure, wherein each turn within the windings includes portions extending axially along an outer surface of the center structure and portions extending across ends of the center structure, wherein at least two adjacent axial portions of formed by two or more consecutive turns are wound to conduct current in a same direction.

2. An inductor comprising:

a center structure; and axial windings around the center structure, wherein each turn within the windings includes portions extending axially along an outer surface of the center structure and portions extending across ends of the center structure, wherein at least two adjacent axial portions of two or more turns are wound to conduct current in a same direction, and wherein the windings include a first set of adjacent axial portions on a first portion of the outer surface of the center structure which are all wound to carry current in a first axial direction and a second set of axial portions on a second portion of the outer surface of the center structure which are all wound to carry current in a second axial direction opposite the first axial direction.

3. An inductor according to claim 2, wherein the portions of each turn extending across ends of the center structure cross over portions of previous turns extending across ends of the center structure.

4. An inductor according to claim 2, wherein the first and second set of adjacent axial portions are both formed by consecutive turns.

5. An inductor comprising:

a center structure; and axial windings around the center structure, wherein each turn within the windings includes portions extending axially along an outer surface of the center structure and portions extending across ends of the center structure, wherein at least two adjacent axial portions of two or more turns are wound to conduct current in a same direction, and wherein the turns include first adjacent axial portions on a first half of the outer surface of the center structure all wound to conduct current in a first axial direction within the first adjacent axial portions and second adjacent axial portions on a second half of the outer surface of the center structure all wound to conduct current in a second axial direction within the second adjacent axial portions.

6. An inductor according to claim 5, wherein the first and second adjacent axial portions are formed by uniformly spaced consecutive turns progressing around the outer surface of the center structure.

7. A power system for borehole production, comprising:

an electric drive including connections for coupling to a power source and producing electric power for artificial lift equipment within a borehole;

a filter coupled to an output of the electric drive; and at least one inductor within the filter, the inductor comprising:

a center structure; and axial windings around the center structure, wherein each turn within the windings includes portions extending axially along an outer surface of the center structure and portions extending across ends of the center structure, wherein at least two adjacent axial portions of two or more turns are wound to conduct current in a same direction.

8. A The power system according to claim 7, wherein consecutive turns of the windings include the at least two adjacent axial portions.

9. The power system according to claim 7, wherein the portions of each turn extending across ends of the center structure cross over portions of previous turns extending across ends of the center structure.

10. The power system according to claim 7, wherein the windings include a first set of adjacent axial portions on a first portion of the outer surface of the center structure which are all wound to carry current in a first axial direction and a second set of axial portions on a second portion of the outer surface of the center structure which are all wound to carry current in a second axial direction opposite the first axial direction.

11. The power system according to claim 10, wherein the first and second set of adjacent axial portions are both formed by consecutive turns.

12. The power system according to claim 7, wherein the turns include first adjacent axial portions on a first half of the outer surface of the center structure all wound to conduct current in a first axial direction within the first adjacent axial portions and second adjacent axial portions on a second half of the outer surface of the center structure all wound to conduct current in a second axial direction within the second adjacent axial portions.

13. The power system according to claim 12, wherein the first and second adjacent axial portions are formed by uniformly spaced consecutive turns progressing around the outer surface of the center structure.

14. A method of forming an inductor, comprising:

providing a center structure; and winding turns axially around the center structure, wherein each turn within the windings includes portions extending axially along an outer surface of the center structure and portions extending across ends of the center structure, wherein at least two adjacent axial portions formed by two or more consecutive turns are wound to conduct current in a same direction.

15. A method of forming an inductor, comprising:

providing a center structure; and winding turns axially around the center structure wherein each turn within the windings includes portions extending axially along an outer surface of the center structure and portions extending across ends of the center structure, by winding the turns to include first adjacent axial portions on a first half of the outer surface of the center structure all wound to conduct current in a first axial direction within the first adjacent axial portions and second adjacent axial portions on a second half of the outer surface of the center structure all wound to conduct current in a second axial direction within the second adjacent axial portions, and wherein at least two adjacent axial portions of two or more turns are wound to conduct current in a same direction.

16. A method of forming an inductor, comprising:

providing a center structure; and winding turns axially around the center structure wherein each turn within the windings includes portions extending axially along an outer surface of the center structure and portions extending across ends of the center structure, by winding a first set of adjacent axial portions on a first portion of the outer surface of the center structure to carry current in a first axial direction and a second set of axial portions on a second portion of the outer surface of the center structure to carry current in a second axial direction opposite the first axial direction, and wherein at least two adjacent axial portions of two or more turns are wound to conduct current in a same direction.

17. The method according to claim 16, wherein the step of winding turns axially around the center structure further comprises:

crossing the portions of each turn extending across ends of the center structure over portions of previous turns extending across ends of the center structure.

18. The method according to claim 16, further comprising:

forming the first and second set of adjacent axial portions by consecutive turns.

* * * * *